US008492977B2

(12) United States Patent
Safarikas et al.

(10) Patent No.: US 8,492,977 B2
(45) Date of Patent: Jul. 23, 2013

(54) LIGHTING UNIT USING A RETRO-FORMED COMPONENT

(75) Inventors: Al Safarikas, Cary, NC (US); John R. Rowlette, Raleigh, NC (US); Craig William Hardin, Apex, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 202 days.

(21) Appl. No.: 12/842,139

(22) Filed: Jul. 23, 2010

(65) Prior Publication Data

US 2012/0019137 A1 Jan. 26, 2012

(51) Int. Cl.
*F21V 15/00* (2006.01)

(52) U.S. Cl.
USPC ..... 315/32; 362/362; 362/373; 362/375; 362/294

(58) Field of Classification Search
USPC ..... 325/32; 362/326, 294, 362, 373, 362/375, 650; 315/32
See application file for complete search history.

(56) References Cited

U.S. PATENT DOCUMENTS

| | | | | |
|---|---|---|---|---|
| 7,784,969 | B2 * | 8/2010 | Reisenauer et al. | 362/294 |
| 7,959,329 | B2 * | 6/2011 | Van De Ven | 362/373 |
| 2005/0057187 | A1 * | 3/2005 | Catalano | 315/291 |
| 2009/0273940 | A1 * | 11/2009 | Thurgood et al. | 362/373 |
| 2009/0284958 | A1 * | 11/2009 | Pickard et al. | 362/147 |
| 2011/0069499 | A1 * | 3/2011 | Trott et al. | 362/365 |
| 2011/0089830 | A1 * | 4/2011 | Pickard et al. | 315/32 |
| 2011/0285267 | A1 * | 11/2011 | Lu et al. | 313/46 |
| 2012/0293982 | A1 * | 11/2012 | Labans | 362/95 |

* cited by examiner

*Primary Examiner* — Don Le
(74) *Attorney, Agent, or Firm* — Steven B. Phillips; Moore & Van Allen PLLC

(57) ABSTRACT

An LED lighting system using a retro-formed component is disclosed. Embodiments of the invention make use of a component that has an external form factor of a structural element of a pre-existing light fixture. The component, for example, can be a power supply, or a heat sink with a connector. The component allows an LED lighting unit to be used without having the power supply and/or a heat sink take up space within what a consumer would normally see as the light bulb. In some embodiments the form factor is that of a screw-in socket such as an Edison E-26 socket. A connector or connectors can allow removal of the power supply portion of the lighting unit, or of the LED and possibly an optical element from the power supply.

25 Claims, 18 Drawing Sheets

LIGHTING UNIT USING A RETRO-FORMED COMPONENT

BACKGROUND

Light emitting diode (LED) lighting systems are becoming more prevalent as replacements for existing lighting systems. LEDs are an example of solid state lighting and have advantages over traditional lighting solutions such as incandescent and fluorescent lighting because they use less energy, are more durable, operate longer, can be combined in red-blue-green arrays that can be controlled to deliver virtually any color light, and contain no lead or mercury.

In many applications, one or more LED dies (or chips) are mounted within an LED package or on an LED module, which may make up part of a lighting unit, lamp, "light bulb" or more simply a "bulb," which includes one or more power supplies to power the LEDs. Some units include multiple LED modules. A module or strip of a fixture includes a packaging material with metal leads (to the LED dies from outside circuits), a protective housing for the LED dies, a heat sink, or a combination of leads, housing and heat sink.

An LED bulb may be made with a form factor that allows it to replace a standard threaded incandescent bulb, or any of various types of fluorescent lamps. LED fixtures and lamps often include some type of optical elements external to the LED modules themselves. Such optical elements may allow for localized mixing of colors, collimate light, and provide the minimum beam angle possible. Forming an LED lighting unit as a conventional light bulb of one kind or another allows a consumer to replace standard fluorescent or incandescent light sources with more efficient LED light sources while maintaining the sometimes significant investment in light fixtures that compliment a chosen décor.

SUMMARY

Embodiments of the present invention provide LED lighting units for conventional light fixtures wherein a lighting unit makes efficient use of space through use of components such as a power supply and/or a heat sink that fit within the envelope of a structural element of the light fixture. Thus, the pre-existing light fixture can be retrofit with an LED light unit, without having such components take up space within what a consumer sees as the light bulb. Such a design provides for more flexible light patterns that can be made to better emulate those of traditional incandescent or fluorescent bulbs without dark areas caused by components inside the envelope of the light bulb.

An LED lighting unit according to example embodiments of the invention includes a component having an external form factor corresponding to a structural element of a pre-existing light fixture. Such a component may be referred to herein as a "retro-formed" component. In some embodiments, the component is a power supply that includes power supply circuitry and is assembled by enclosing the circuitry in a casing with the required form factor. In some embodiments the external form factor is that of a screw-in socket. In some embodiments, this form factor is that of an Edison socket such as an E-26 socket, however, any other structural component form factors can be used, and other screw-in socket form factors can be used.

In some embodiments, the lighting unit includes a heat sink in thermal communication with the light source. The light source may be a single LED or multiple LEDs used in combination, in either a single device package or multiple device packages used in combination. This thermal communication can be either direct or indirect and the heat sink can also be in thermal communication with the power supply. The heat sink can be disposed around the power supply or can be disposed more directly above or below a light source such as an LED or LEDs.

In some embodiments, one heat sink forms all or a portion of the retro-formed component and there is an additional heat sink in the lighting unit. In some embodiments, the lighting unit includes an optical element disposed to receive light and then redirect, focus, mix, or otherwise manipulate the light leaving the lighting unit to desired effect.

In some embodiments, the component that is designed with an external form factor corresponding to a structural element of a pre-existing light fixture can be a heat sink with at least a portion of a connector. In some embodiments the LED lighting unit can include a connector disposed to removably attach the light source and/or the optical element and/or the heat sink to the power supply. The LED and/or optical element of the lighting unit, possibly in addition to other components, can be adapted to be rotatable independent of the power supply in order to redirect light from the LED or LEDs. In some embodiments, a fixed connector portion that resides with the heat sink in the light fixture can be arranged to allow the power supply and/or an LED and/or an optical element to be removably connected to the heat sink by a removable connector portion while the heat sink remains in the pre-existing light fixture in which the lighting unit is used.

BRIEF DESCRIPTION OF THE DRAWINGS

FIG. 3 is illustrated in three views further designed as FIGS. 3A, 3B and 3C.

FIG. 5 is illustrated in four views further designed as FIGS. 5A, 5B, 5C and 5D.

FIG. 6 is illustrated in three views further designed as FIGS. 6A, 6B and 6C.

FIG. 7 is illustrated in two views further designed as FIGS. 7A and 7B.

FIG. 9 is illustrated in two views further designed as FIGS. 9A and 9B.

DETAILED DESCRIPTION

The following detailed description refers to the accompanying drawings, which illustrate specific embodiments of the invention. Other embodiments having different structures and operation do not depart from the scope of the present invention.

Embodiments of the invention are described with reference to drawings included herewith. Like reference numbers refer to like structures throughout. It should be noted that the drawings are schematic in nature. Not all parts are always shown to scale. The drawings illustrate but a few specific embodiments of the invention.

In example embodiments, the light fixture is typically one that was originally designed for convention fluorescent or incandescent bulbs, notwithstanding the fact that the same or a similar fixture could be manufactured with LED lighting units according to example embodiments of the invention. Also, the term "structural element" is intended in its broadest sense to be anything that takes up a portion of the structure of a light fixture. Thus, a "structural element" might be an electronic component such a ballast transformer or a switch. When a component has an external form factor that "corresponds" to a structural element of a pre-existing light fixture, what is meant is that the component fits within the space previously occupied by the structural element in at least on dimension. In some instances, the element may exceed the size of a structural element in some dimension or dimensions but would still be able to replace the structural element without modification to the rest of the light fixture.

Figure 1:
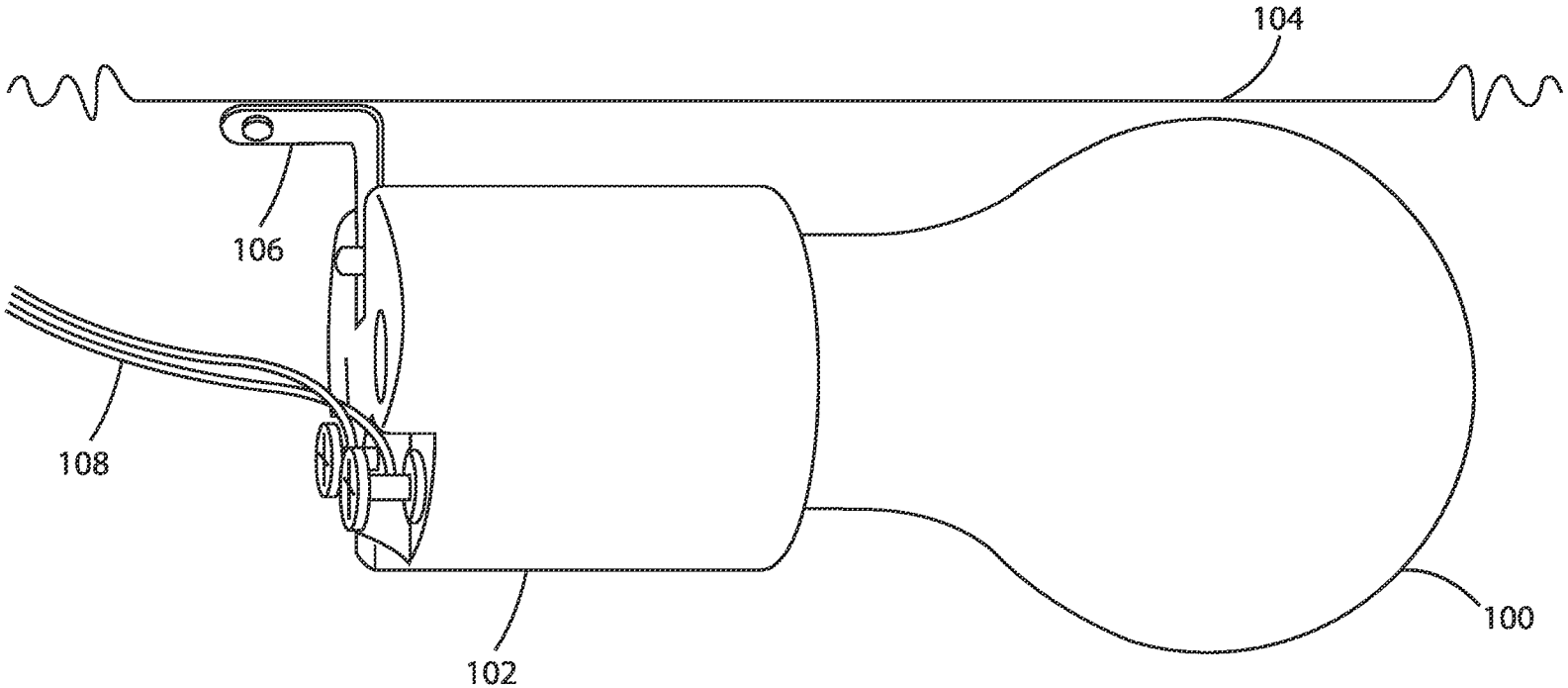
FIG. 1 (PRIOR ART)
FIG. 1 shows a portion of a pre-existing light fixture with which an embodiment of the present invention might find use.

FIG. 1 illustrates at least a portion of a pre-existing light fixture with which an embodiment of the present invention might find use. In FIG. 1 a standard incandescent light bulb 100 installed in an Edison E-26 socket so that the bulb is suspended horizontal below the top surface 104 of a ceiling fixture. The socket 102 is a structural element of the light fixture, and is fastened to the light fixture with screws and metal bracket 106. AC wiring 108 connects the socket to a residential or commercial AC circuit.

Figure 2:
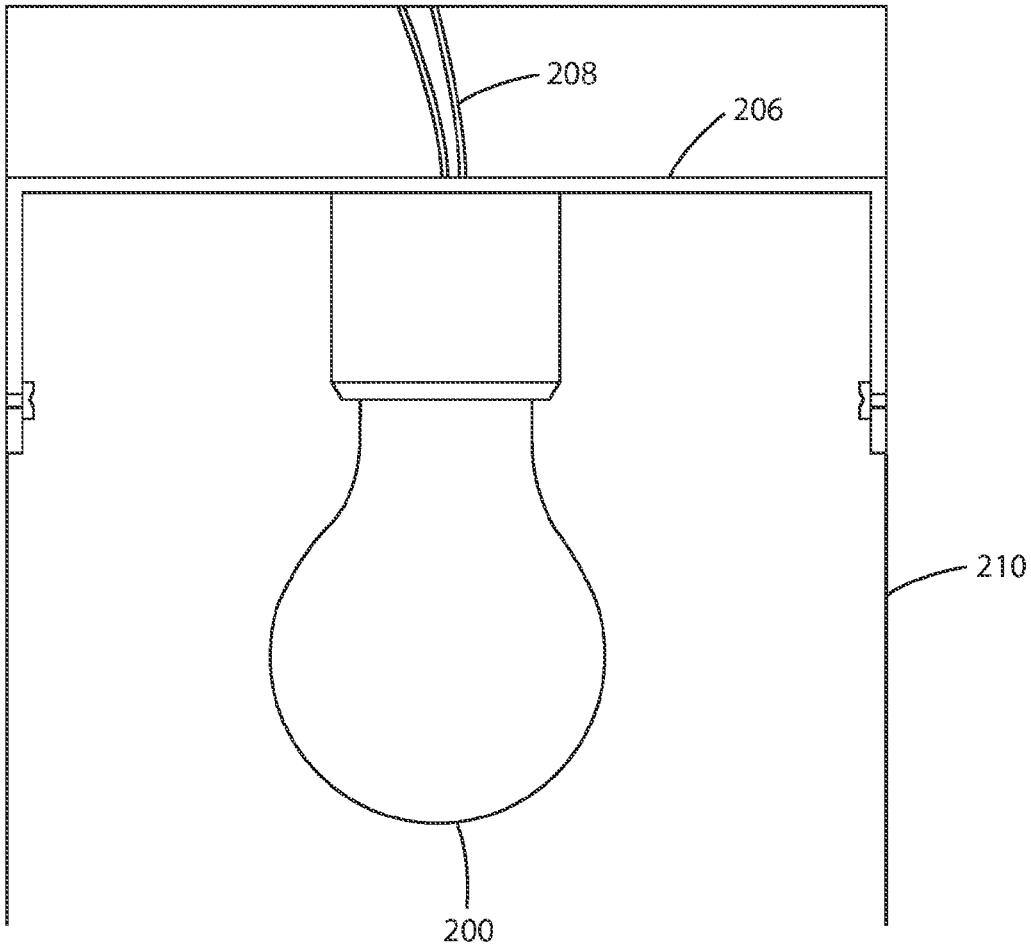
FIG. 2 (PRIOR ART)
FIG. 2 shows another pre-existing light fixture with which an embodiment of the present invention might find use.

FIG. 2 shows a standard incandescent bulb 200 held vertically in light fixture 201 by being installed in an Edison screw-in socket 202. The socket is fastened to a bracket 206 and AC wiring 208 is connected to socket 202.

Figure 3A:
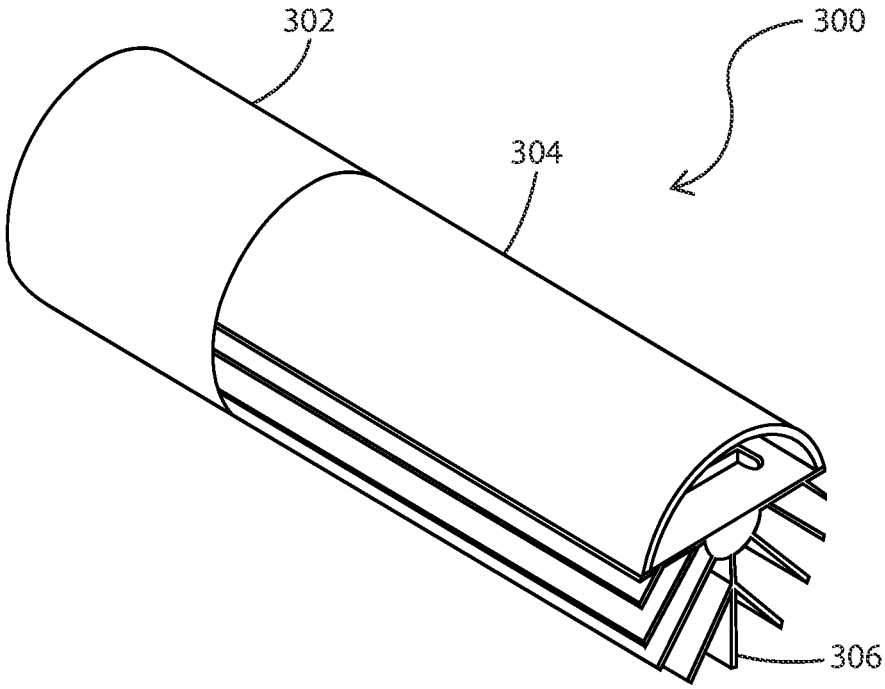
FIG. 3 illustrates a lighting unit according to an example embodiment of the present invention.
Figure 3B:
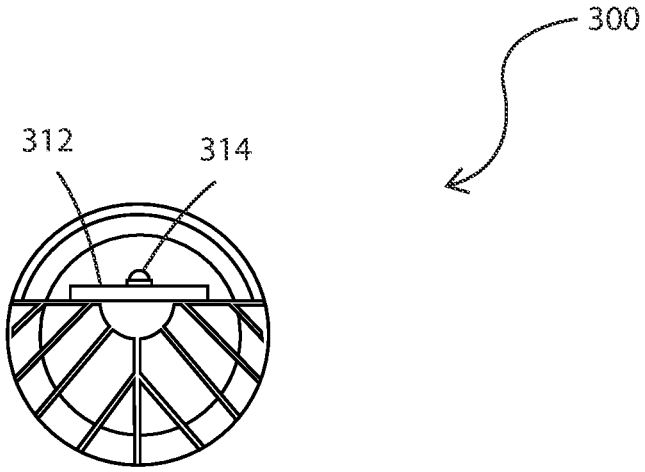
Figure 3C:
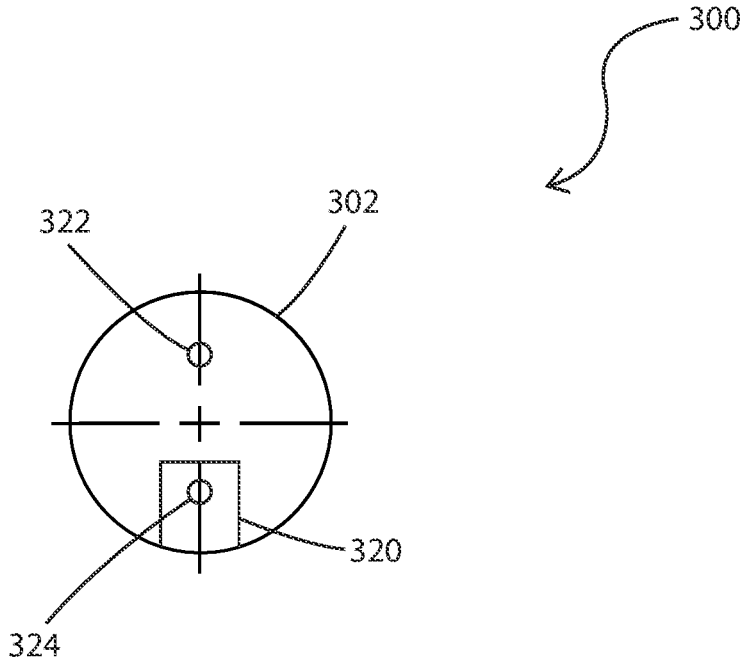

FIG. 3 illustrates a lighting unit according to an example embodiment of the present invention. The lighting unit of FIG. 3 is designed for horizontal mounting. FIG. 3 shows lighting unit 300 in three different views. FIG. 3A is a perspective view. FIGS. 3B and 3C are end views. Lighting unit 300 includes a retro-formed component, namely, power supply 302. Lighting unit 300 also includes optical element 304 and heat sink 306. The external casing of power supply 302 is of a diameter and length such that the external form factor of the power supply corresponds to an Edison E-26 socket, a structural element of many, pre-existing standard light fixtures. Circuit board 310 is disposed on heat sink 306 beneath optical element 304. The heat sink is a finned design, which can be made from aluminum, although other materials, such as thermally conductive plastic can be used. Heat sink 306 is in thermal communication with the light source and may also be in thermal communication with the power supply. Such thermal communication can be direct or indirect. The optical element can be made of plastic or glass, and can be shaped to have some lens-like properties and/or be treated to cause color mixing. The color mixing can be used if individual LED dies emit light of different colors.

FIG. 3B shows an end view of lighting unit 300 where circuit board 312 is more readily visible. In this example embodiment, circuit board 312 includes multiple LED devices 314, each one consisting of actual LEDs encapsulated in a package with mounting leads and a domed lens. In some embodiments red, green and blue LEDs in each package can be used to produce white light. Alternatively, two colors can be used to produce white light. For example, the light from red and blue-shifted-yellow (BSY) LEDs can be combined into white light. In any case, the LED packages 314 in FIG. 3B are connected to the power supply by appropriate wiring or circuit board traces so that the circuitry in the power supply powers the LEDs. Note that it would also be possible to use a phosphor coated optical element in a lighting unit according to an embodiment of the invention. In such a design, the phosphor on the optical element gives off white light when energized by blue or ultraviolet light from the LEDs.

FIG. 3C illustrates the other end of lighting unit 300. Power supply 302 in this case includes screw mounting holes 322 and 324. Thus, the back end of the lighting unit appears almost exactly the same electrically and physically as the back end of an Edison socket, with screw mounting hole 324 being surrounded by metal tab 320. The pair of screw mounting holes is centered as indicated by the center lines of the figure. AC wiring can be connected to additional screw tabs (not shown) or can be hard wired to the power supply circuit with wires (not shown in this Figure) exiting the casing of the power supply for hot and neutral power connections.

Figure 4:
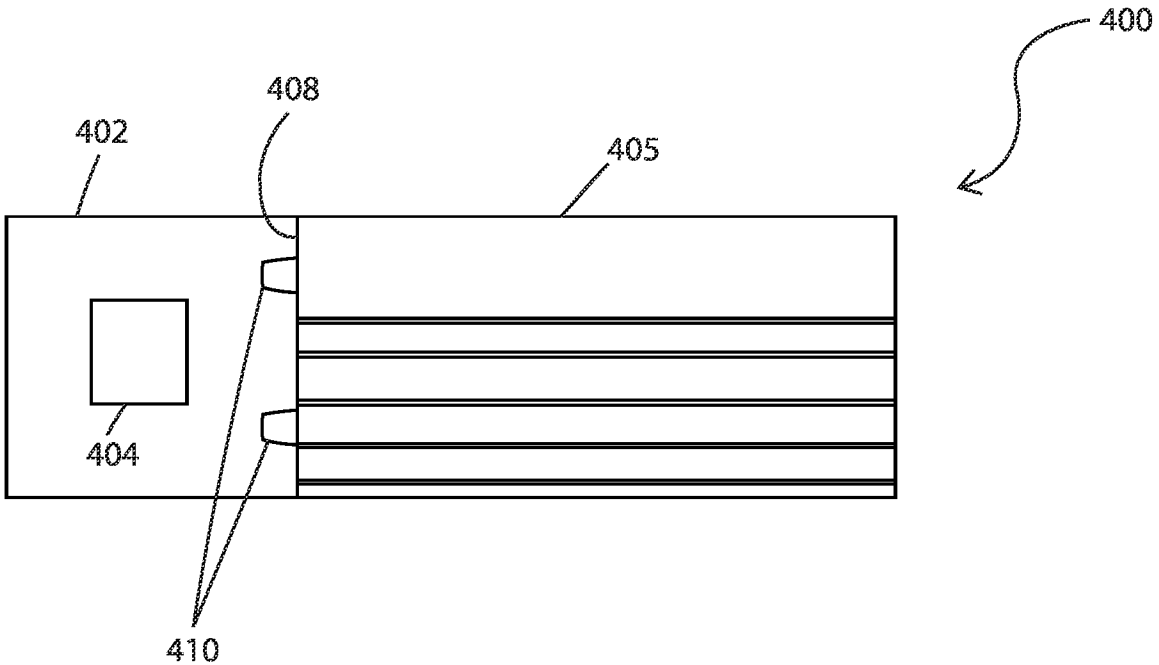
FIG. 4 is a side view of a lighting unit according to another example embodiment of the present invention.

FIG. 4 is a side view of a lighting unit that is externally almost identical to that shown in FIG. 3. However, in this case, power supply 402 of lighting unit 400 is shown "see-through" so that some internal features can be seen. Power supply circuitry 404 can be seen within the casing of power supply 402. This power supply circuitry can be a single-chip power supply for LEDs that reside under optical element 405. In addition to a single-chip power supply component, however, the active portion of the power supply can consist of or include discrete circuits made up of a number of power supply components such as transistors, diodes, capacitors, resistors, inductors, and the like.

Still referring to FIG. 4, the embodiment of FIG. 4 is distinguished by a connector at physical interface 408 between the retro-formed power supply and the other parts of lighting unit 400. Connector portions 410 protrude into the power supply casing and can be seen in FIG. 4 since the power supply 402 is see-through in this view. In this example embodiment, these connector portions engage with openings in the power supply casing, and include electrical contacts. However, many different types and styles of connectors can be used to removably attach the power supply to the rest of the lighting unit. Such a connector could be a pin-and-socket type, a bayonet type, a force-fit plug, etc. and be of a positive locking and/or quick release type. This connector allows the other components to removably attach to power supply 402. In this example the other components include the LEDs, the heat sink, and the optical element. In other example designs, one of some subset of these components might removably attach to the power supply.

Note that with respect to the lighting units shown in FIGS. 3 and 4, in addition to a connector optionally allowing removal of the portion of the lighting with the LEDs, a connector or some other mechanical interface can be used to allow the LED portion to be rotatable independent of the power supply. Such an arrangement would allow the light to be directed while still maintaining thermal and electrical communication between the power supply and the rest of the lighting unit.

FIG. 5 illustrates another lighting unit according to an example embodiment of the present invention. The lighting unit of FIG. 5 is also designed for horizontal mounting and is very similar to the lighting units discussed thus far, however it provides a mounting option that permits the heat sink to be spaced away from the top surface of a fixture to allow for more efficient cooling. FIG. 5 shows lighting unit 500 in four different views. FIG. 5A is a perspective view. FIGS. 5B and 5C are end views, and FIG. 5D is a top view showing additional mounting holes relative to the previous embodiments. Lighting unit 500 includes a retro-formed power supply 502. Lighting unit 500 also includes optical element 504 and heat sink 506. The external casing of power supply 502 is of a width and length such that the external form factor of the power supply corresponds to an Edison E-26 socket in width and length. In this case, standoff portion 511 can serve to keep the heat sink spaced away from a wall of the light fixture to provide for more efficient cooling.

Still referring to FIG. 5, circuit board 512 is disposed on heat sink 506 beneath optical element 504. The heat sink is a finned design, which can be made from aluminum, although other materials, such as thermally conductive plastic can be used. Heat sink 506 is in thermal communication with the light source and may also be in thermal communication with the power supply. Such thermal communication can be direct or indirect. The optical element can be made of plastic or glass, and can be shaped to have some lens-like properties and/or be treated to cause color mixing. The color mixing can be used if individual LED dies emit light of different colors.

Figure 5A:
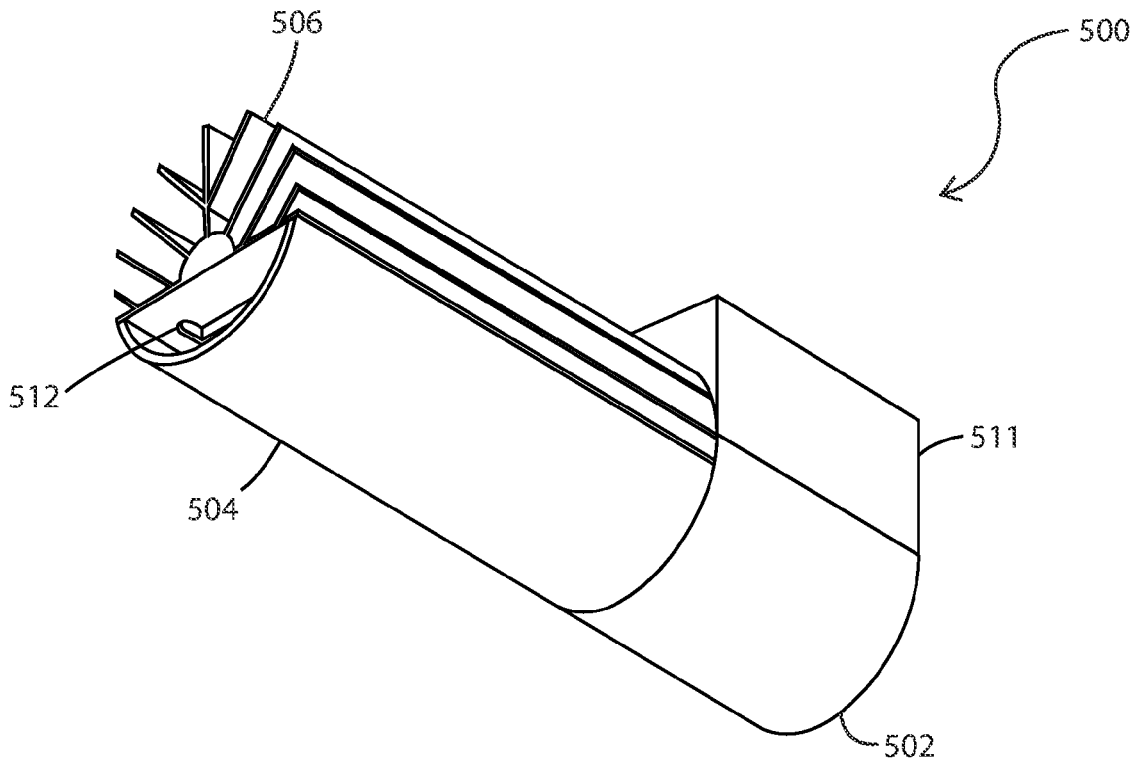
FIG. 5 illustrates a lighting unit according to another example embodiment of the present invention.
Figure 5B:
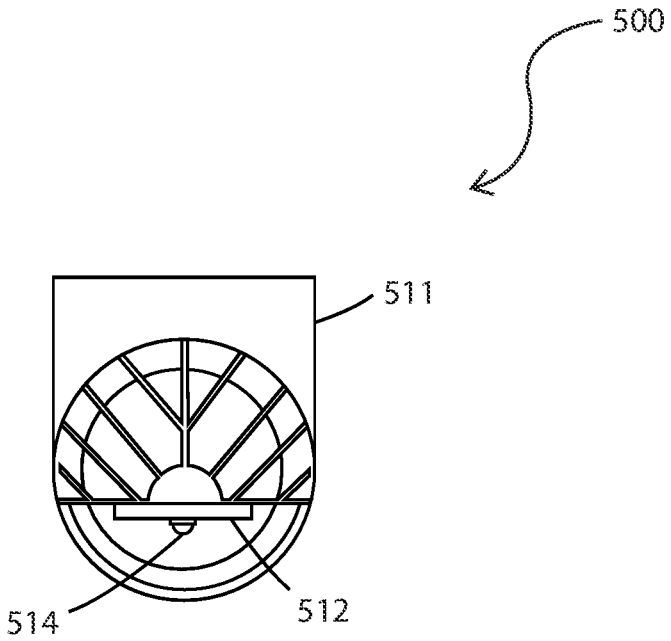

FIG. 5B shows an end view of lighting unit 500 where circuit board 512 is more readily visible. In this example embodiment, as before, circuit board 512 includes multiple LED devices 514, each one consisting of actual LEDs encapsulated in a package with mounting leads and a domed lens. The LED packages 514 in FIG. 5B are connected to the power supply by appropriate wiring or circuit board traces so that the circuitry in the power supply powers the LEDs. Again, it would also be possible to use a phosphor coated optical element in a lighting unit according to an embodiment of the invention. In such a design, the phosphor on the optical element gives off white light when energized by blue or ultraviolet light from the LEDs.

Figure 5C:
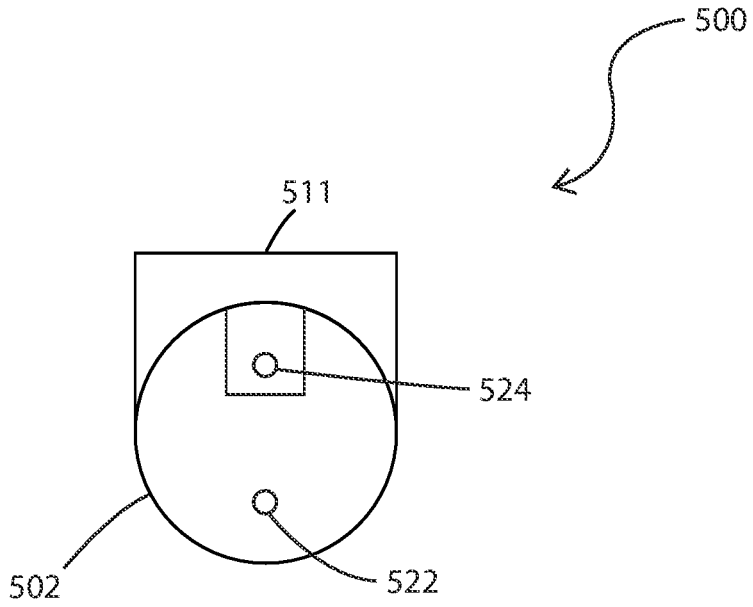

FIG. 5C illustrates the other end of lighting unit 500. Power supply 502 in this case includes screw mounting holes 522 and 524. AC wiring can be connected to additional screw tabs (not shown) or can be hard wired to the power supply circuit with wires (not shown in this Figure) exiting the casing of the power supply for hot and neutral power connections.

Figure 5D:
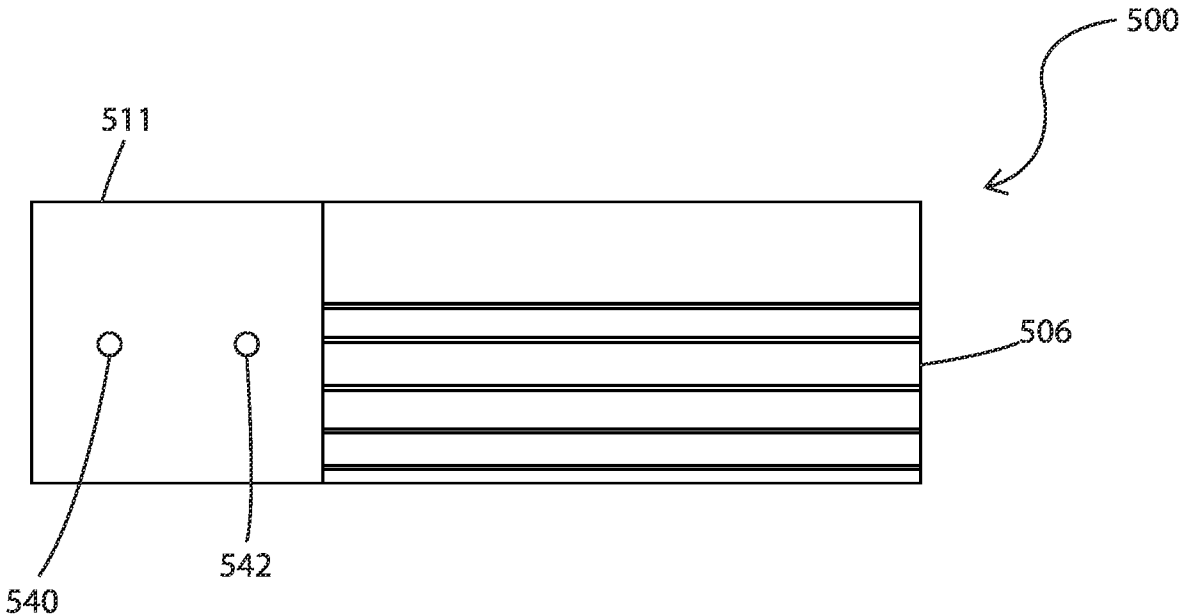

FIG. 5D is a top view of lighting unit 500. Additional screw holes 540 and 542 provide an alternate mounting option in which a bracket would typically not be used. In such a case, the lighting unit can be fastened to the fixture casing and an appropriate spacing is maintained between the heat sink and the fixture to allow efficient cooling of the lighting unit.

Figure 6A:
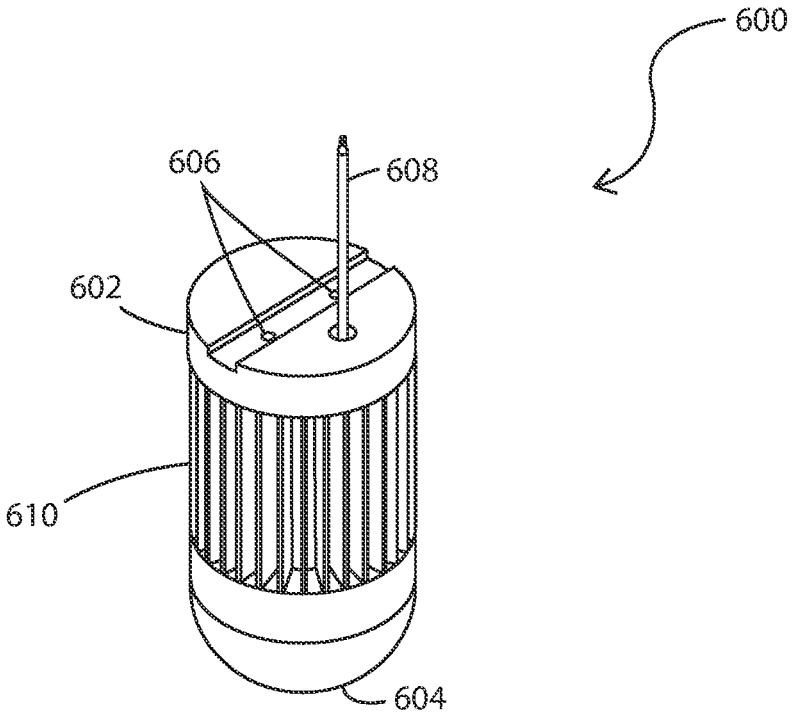
FIG. 6 illustrates a lighting unit according to another example embodiment of the present invention.
Figure 6B:
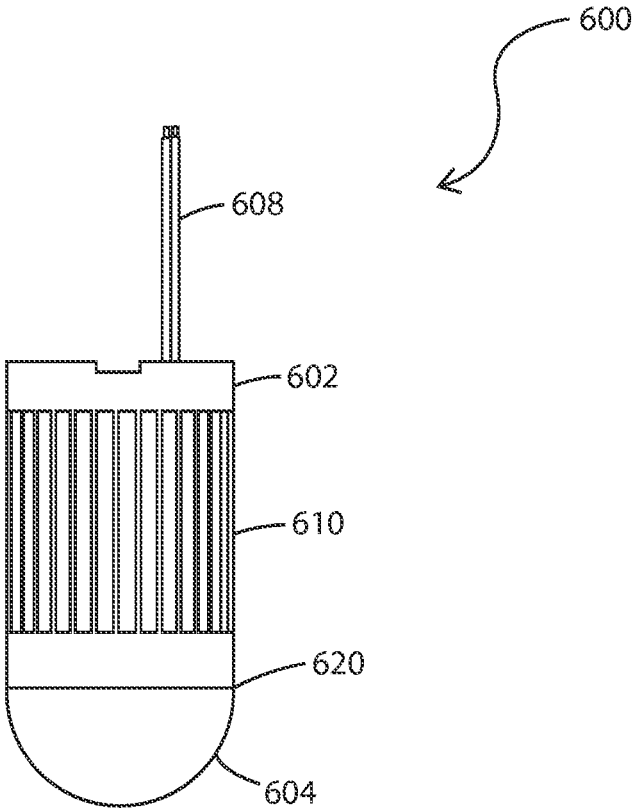
Figure 6C:
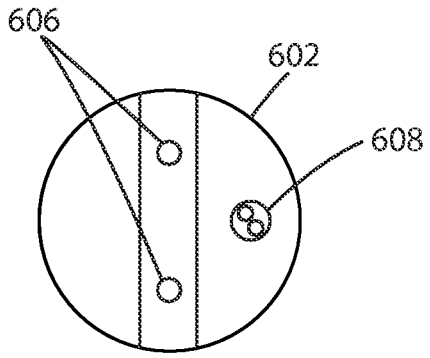

FIG. 6 illustrates a lighting unit with a retro-formed power supply according to another embodiment of the invention. FIG. 6 illustrates lighting unit 600 in three views. FIG. 6A is a perspective view, FIG. 6B is a side view and FIG. 6C is a top view. Lighting unit 600 includes again includes as a retro-formed component a power supply 602. Lighting unit also includes optical element 604. An LED or multiple LEDs (not visible) is/are mounted on a circuit board under optical element 604. In this case, power supply 600 is again of an outside diameter and length such that the external form factor of the power supply corresponds to an Edison socket, a structural element of many standard light fixtures. This particular lighting unit is mounted with screws via screw holes 606. The hard-wired AC line cord 608 is shown in these views.

Still referring to FIG. 6, heat sink 610 is visible in the perspective view of FIG. 6A and the side view of FIG. 6B. In the embodiment of FIG. 6, heat sink 610 is disposed around the power supply and may be integrally molded, machined, or otherwise formed into the casing of the power supply. The heat sink is in thermal communication with the light source through the internal structure of the lighting unit and thermal communication may be direct or indirect. In at least some embodiments the heat sink is also in thermal communication with the power supply circuitry. Also in the embodiment of FIG. 6, interface 620, as most readily visible in FIG. 6B, can accommodate a connector to removably attach different light sources and possibly different light source/optical element combinations.

Figure 7A:
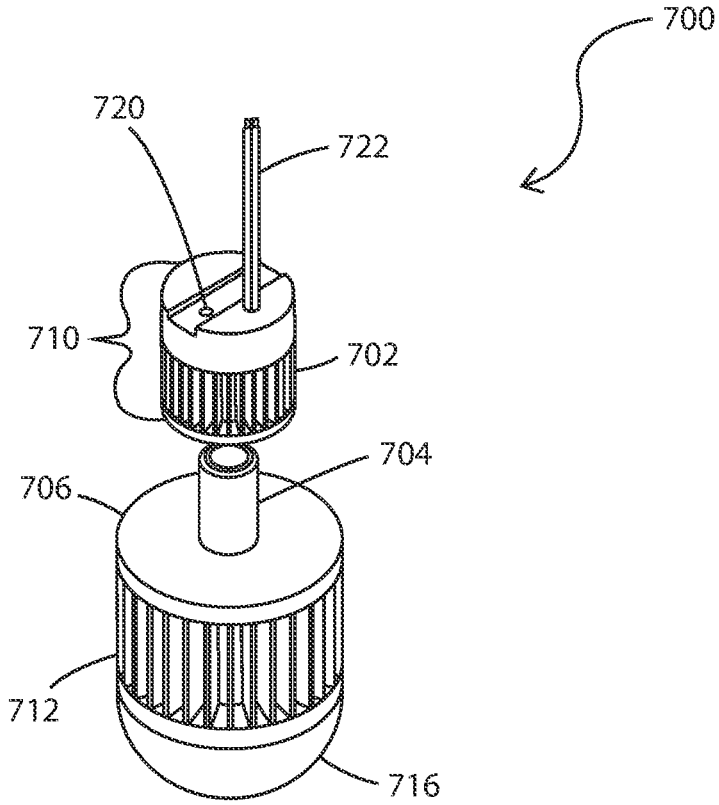
FIG. 7 illustrates a lighting unit according to another example embodiment of the present invention.
Figure 7B:
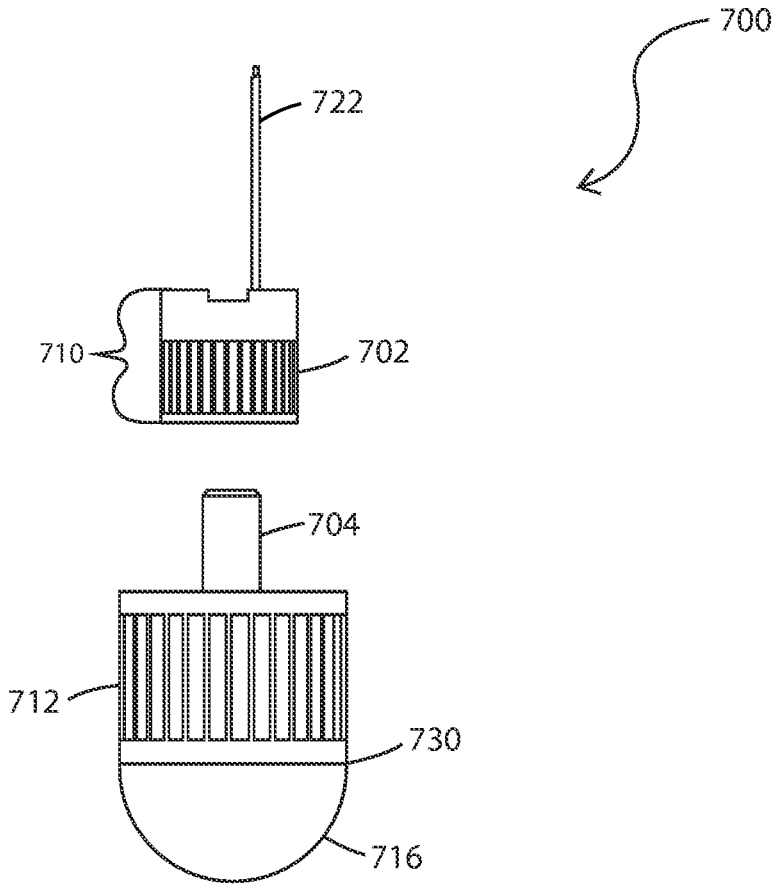

FIG. 7 illustrates another embodiment of the present invention. The lighting unit 700 of FIG. 7 is shown in two views. FIG. 7A is a perspective view and FIG. 7B is a side view. In the case of the lighting unit of FIG. 7, heat sink 702 is disposed around a fixed connector portion (not seen) that receives movable connector portion 704 which is attached to power supply 706. Component 710 of lighting unit 700 is a retro-formed component having an external form factor corresponding to a structural element of a pre-existing light fixture. In the example of FIG. 7, first heat sink 702 provides a portion of the heat removal for the lighting unit, and a second heat sink 712 disposed around power supply 706 provides another portion of the heat removal required for an LED or LEDs (not visible) installed beneath optical element 716. In the example of FIG. 7, component 710 has an outside diameter and length such that the external form factor of the component corresponds to an Edison socket, a structural element of many standard light fixtures. Component 710 is designed to replace a socket that is mounted with screws via screw holes and connected with a hard-wired AC line cord, and thus includes screw mounting holes 720 and AC line cord 722.

The lighting unit of FIG. 7 allows the power supply and LED arrangement to be replaced easily, while leaving the first heat sink and the fixed connector portion fixedly attached to the lighting fixture. However, an additional connector can be included at interface 730 to allow removal and replacement of the optical element and/or the LED or LEDs if desired. Both connectors used in the example embodiments of the invention described herein can be any of various types, including bayonet connectors, pin-and-socket connectors, force-fit connectors, etc.

Figure 8:
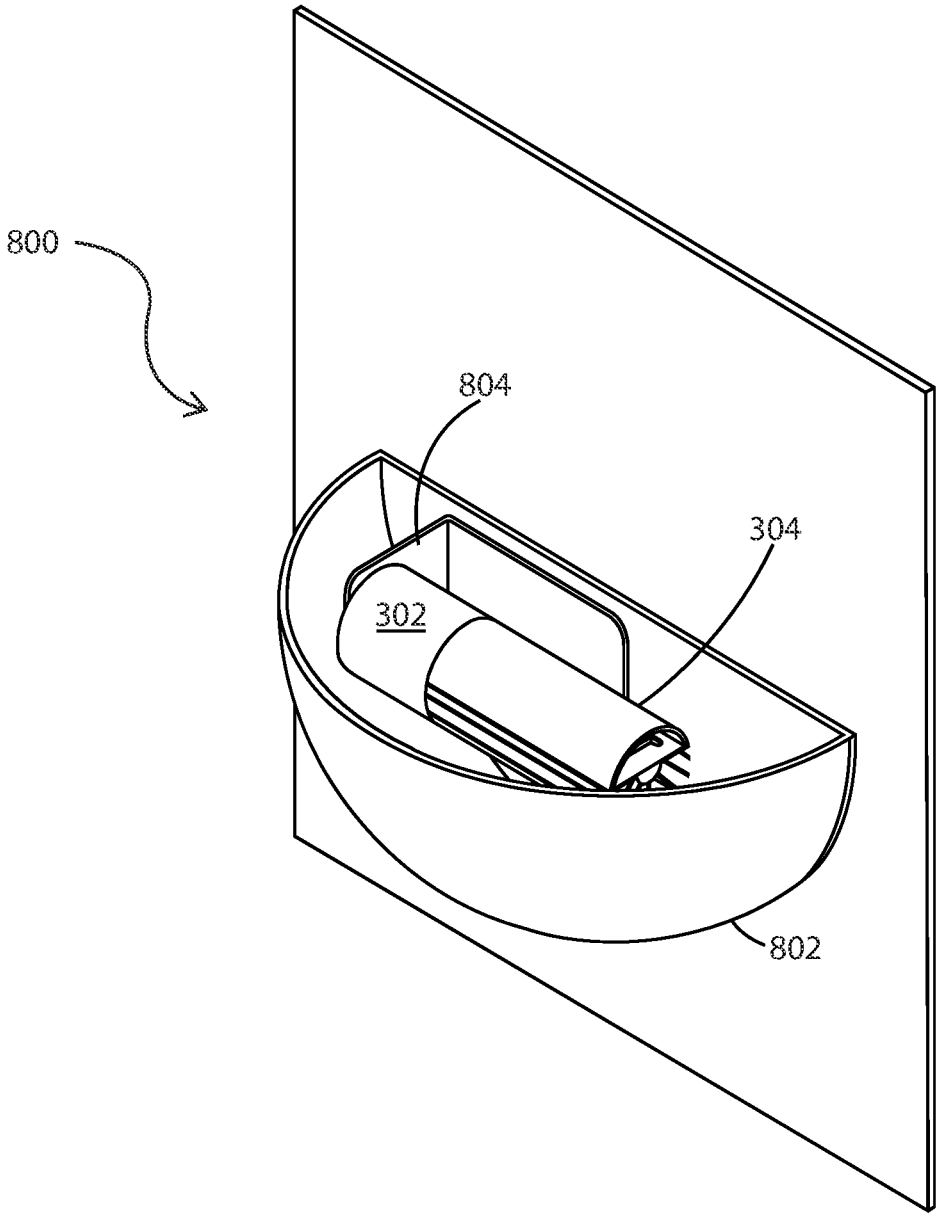
FIG. 8 shows a light fixture incorporating a lighting unit according to an example embodiment of the invention.

FIG. 8 illustrates a light fixture that makes use of the LED lighting unit shown in FIG. 1. FIG. 8 illustrates a walls sconce light fixture 800, with a decorative glass cover 802. A bracket 804 includes electrical wiring (not shown) that allows screws to connect power supply 302 to hot and neutral supply leads and replace what was previously an Edison type socket for an incandescent bulb. Thus, the entire length of optical element 304 can be illuminated by the LEDs, as opposed to having a dark area near the base of an "LED light bulb" that might otherwise be screwed into the Edison socket.

Figure 9A:
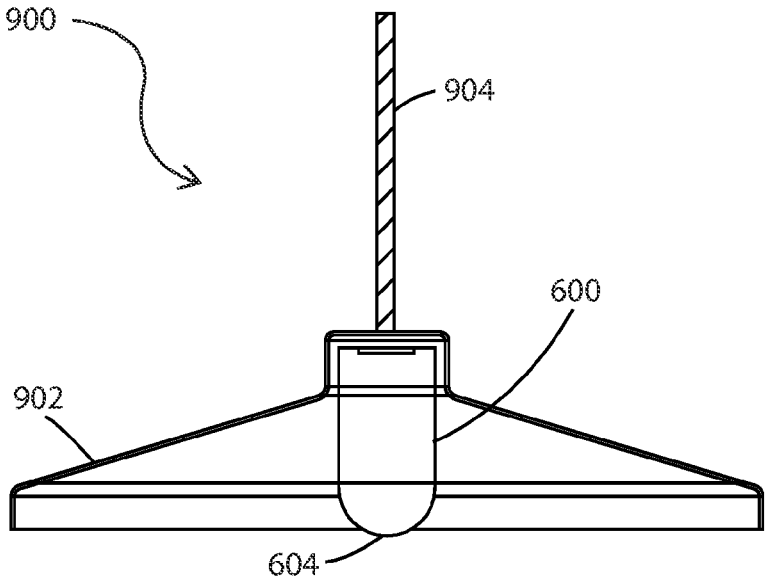
FIG. 9 shows another light fixture incorporating a lighting unit according to an example embodiment of the invention.
Figure 9B:
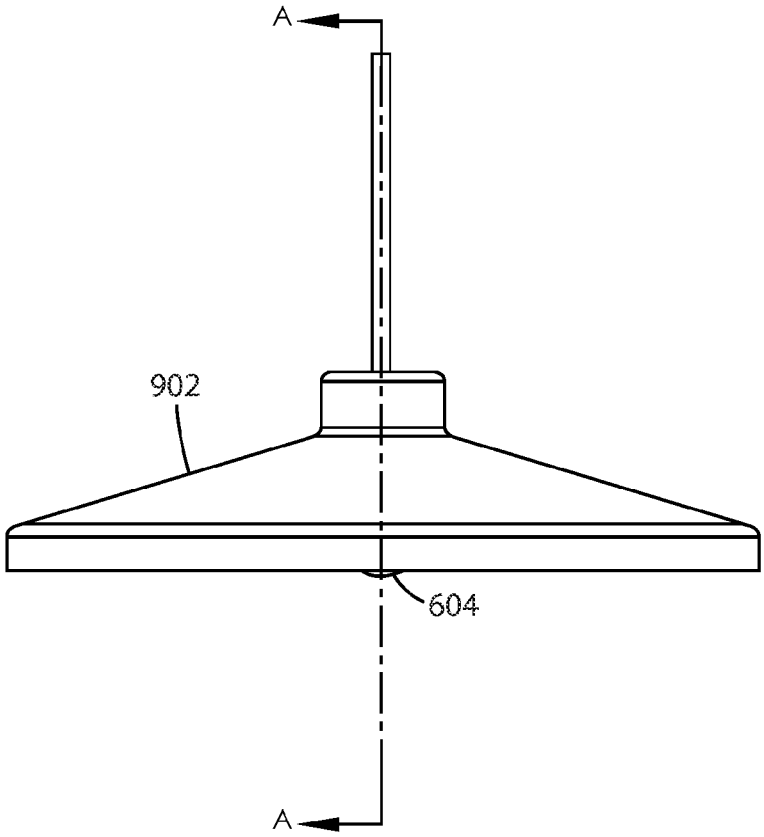

FIG. 9 illustrates pendant light fixture. FIG. 9A is a cross-section and FIG. 9B is a side view of light fixture 900. Light fixture 900 includes LED lighting unit 600 previously described (some detail omitted), which protrudes below decorative hood 902. LED lighting unit 300 is connected to AC line cord 904. Lighting unit 600 has an external form factor like that of an Edison socket for which pre-existing pendant fixture 900 was designed. It should be noted that optical element 604 could be replaced with an optical element that appears more like a standard incandescent light bulb. In such a case, the entire light bulb would appear lit, as there would be no dark area due to power supply components inside the envelope of the bulb.

Figure 10:
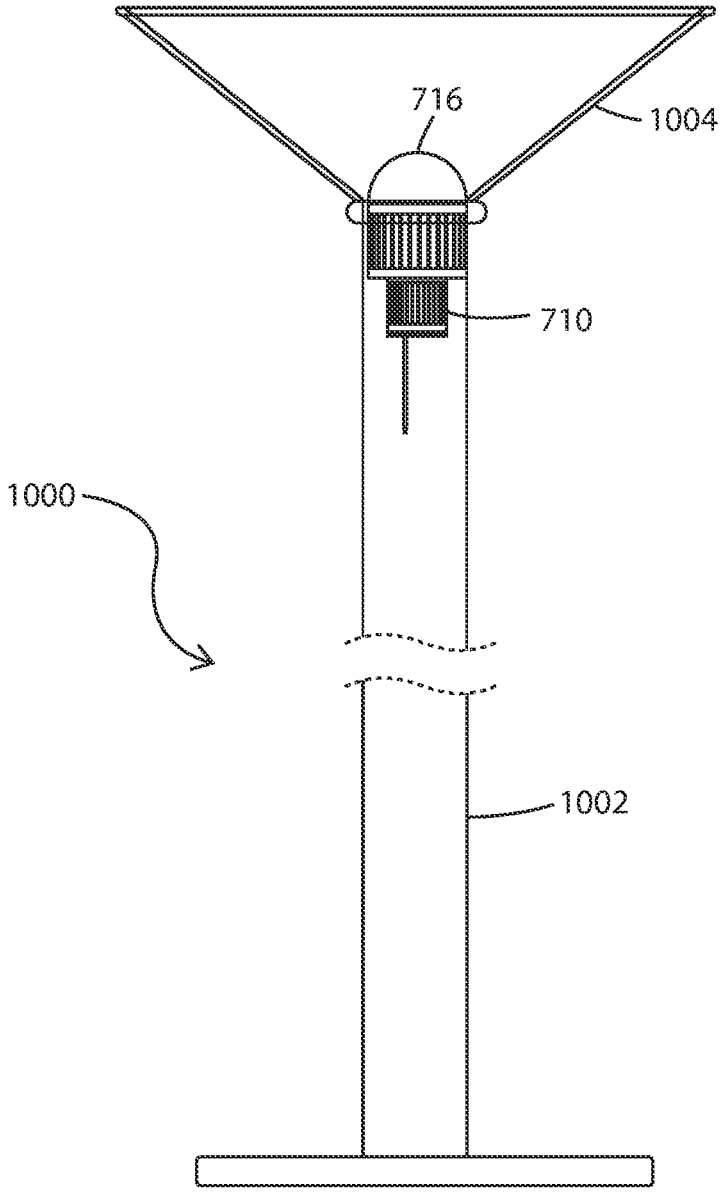
FIG. 10 shows another light fixture incorporating a lighting unit according to an example embodiment of the invention.

FIG. 10 is a see-through view of a torchiere light fixture 1000 that includes support stanchion 1002 and decorative shade 1004. Light fixture 1000 includes the LED lighting unit previously shown in FIG. 7. In this case, retro-formed component 710 replaces an Edison socket for which this pre-existing fixture was designed. The portion of the lighting unit, including optical element 716 and an LED or LEDs, is attached by a connector as previously described. Also as previously described, the optical element could be any of various shapes, including those that appear more like a standard incandescent bulb.

It cannot be overemphasized that the structural element of the preexisting light fixture, which is replaced by a component of an LED lighting system according to embodiments of the present invention, can be any of various sizes and types. The Edison socket form factors illustrated herein are shown as examples only. As other examples, a power supply or heat sink for an LED lighting unit could be contained in the envelope of an extended base for a candelabra socket like that used in many chandeliers and entry light fixtures. Also, a power supply, heat sink, or other component of an LED lighting unit could be designed to be contained in the envelope of an element of a fluorescent fixture, such as a ballast transformer.

Even in cases where an Edison socket is the structural element replaced, Edison sockets come in various sizes. Standards specify thread diameters from 5 mm to 40 mm. The E-26 socket commonly used for household and commercial standard incandescent bulbs has a thread diameter of 26 mm. The outer diameter of a round socket is typically larger, since the diameter encompasses insulating material and an outer shell. Thus, an E-26 socket might be 28-50 mm in outside diameter, and Edison sockets in general might be from 6 to 70 mm or more in outside diameter, and from 10 to 75 mm in height. Structural elements of pre-existing light fixtures, sockets and/or otherwise could vary in size since some fixtures are decorative and others utilitarian, and some structural elements could include multiple portions, such as a socket in combination with an extender or stanchion. Thus the size of the component that replaces a structural element or elements of a pre-existing fixture could be, as examples only, from 1 to 100 mm in any dimension, from 20 to 80 mm in any dimension, or from 40-60 mm in any dimension.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" and "greater", are intended to encompass the concept of equality, thus, "less" can mean not only "less" in the strictest mathematical sense, but also, "less than or equal to."

It should also be pointed out that references may be made throughout this disclosure to figures and descriptions using terms such as "above", "top", "under", "side", "in", "within", "on", and other terms which imply a relative position of a structure, portion or view. These terms are used merely for convenience and refer only to the relative position of features as shown from the perspective of the reader. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A component for an LED light fixture, the component having an external form factor corresponding to a socket of a pre-existing light fixture, the component further comprising an active portion of a power supply to power an LED.

2. The component of claim 1 wherein the form factor is that of a screw-in socket.

3. The component of claim 2 wherein the form factor is that of an Edison type screw-in socket.

4. The component of claim 1 further comprising a connector to removably attach the component to at least one of the LED, a heat sink, and an optical element.

5. The component of claim 4 wherein the form factor is that of a screw-in socket.

6. The component of claim 5 wherein the form factor is that of an Edison type screw-in socket.

7. The component of claim 1 further comprising a heat sink.

8. An LED light fixture comprising:

a component having an external form factor corresponding to a socket of a pre-existing light fixture;

at least one LED connectable to the component; and an active portion of a power supply disposed within the component, the active portion of the power supply connectable to the at least one LED.

9. The LED light fixture of claim 8 wherein the form factor is that of an Edison type screw-in socket.

10. The LED light fixture of claim 8 further comprising a heat sink in thermal communication with at least one of the at least one LED and the active portion of the power supply.

11. The LED light fixture of claim 10 wherein the at least one LED is adapted to be rotatable independent of the component.

12. The LED light fixture of claim 10 further comprising a connector disposed to removably attach at least one of the at least one LED and the heat sink component.

13. The LED light fixture of claim 8 wherein the LED light fixture is also a pre-existing light fixture.

14. The LED light fixture of claim 12 wherein the LED light fixture is also a pre-existing light fixture.

15. The LED light fixture of claim 10 further comprising an optical element to receive light from the at least one LED.

16. A method of assembling an LED light fixture, the method comprising:

forming a component for the LED light fixture having an external form factor corresponding to a socket of a pre-existing light fixture;

placing an active portion of a power supply in the component; and connecting at least one LED to the component.

17. The method of claim 16 further comprising installing an optical element to receive light from the at least one LED.

18. The method of claim 17 further comprising installing a heat sink to be in thermal communication with at least one of the at least one LED and the active portion of the power supply.

19. The LED lighting unit of claim 15 wherein at least one of the at least one LED and the optical element is adapted to be rotatable independent of the component.

20. Apparatus for connection to a retro-formed component associated with a first heat sink for an LED lighting unit, the apparatus comprising:

a power supply having a removable connector portion that mates with a fixed connector portion associated with the retro-formed component;

a second heat sink disposed around the power supply;

an LED connected to the power supply; and an optical element to receive light from the LED.

21. The apparatus of claim 20 wherein the first heat sink forms at least a portion of the retro-formed component.

22. The apparatus of claim 21 further comprising an additional connector to removably attach at least the optical element to the power supply.

23. A component for an LED light fixture, the component comprising a heat sink and having an external form factor corresponding to a socket of a pre-existing light fixture.

24. The component of claim 23 wherein the form factor is that of an Edison type screw-in socket.

25. The component of claim 24 further comprising a connector to removably attach at least one of an LED and an optical element.

* * * * *